US007137418B2

(12) United States Patent
Robledo et al.

(10) Patent No.: US 7,137,418 B2
(45) Date of Patent: Nov. 21, 2006

(54) PRODUCE TRAY

(75) Inventors: Epitacio Robledo, Guadalajara (MX); David Shaver, Kingsbury, TX (US)

(73) Assignee: Desert Glory, Ltd., San Antonio, TX (US)

( * ) Notice: Subject to any disclaimer, the term of this patent is extended or adjusted under 35 U.S.C. 154(b) by 288 days.

(21) Appl. No.: 10/856,698

(22) Filed: May 28, 2004

(65) Prior Publication Data

US 2005/0266125 A1 Dec. 1, 2005

(51) Int. Cl.
*B65B 1/04* (2006.01)

(52) U.S. Cl. ..... 141/108; 209/614

(58) Field of Classification Search ..... 141/108, 141/313–319, 391; 209/702, 707, 614
See application file for complete search history.

(56) References Cited

U.S. PATENT DOCUMENTS

| | | | | | |
|---|---|---|---|---|---|
| 2,704,974 | A * | 3/1955 | Steman | 99/422 |
| 3,628,659 | A * | 12/1971 | Mitchell | 209/614 |
| 3,747,756 | A * | 7/1973 | Wheeler | 209/703 |
| 5,117,982 | A * | 6/1992 | Shotthafer et al. | 209/614 |
| 5,433,256 | A * | 7/1995 | Vasers | 141/370 |

* cited by examiner

*Primary Examiner*—Steven O. Douglas
(74) *Attorney, Agent, or Firm*—Fulbright & Jaworski LLP

(57) ABSTRACT

The present invention is directed to systems and methods which use a tray to hold and transfer objects, such as produce. The tray has at least one opening to permit the user to manipulate the tray during transfer without touching the contents held within the tray. The tray has an open end with a curved edge to reduce damage to the contents when transferring contents from the tray to a container. The tray is preferably constructed from a plastic-like material.

22 Claims, 2 Drawing Sheets

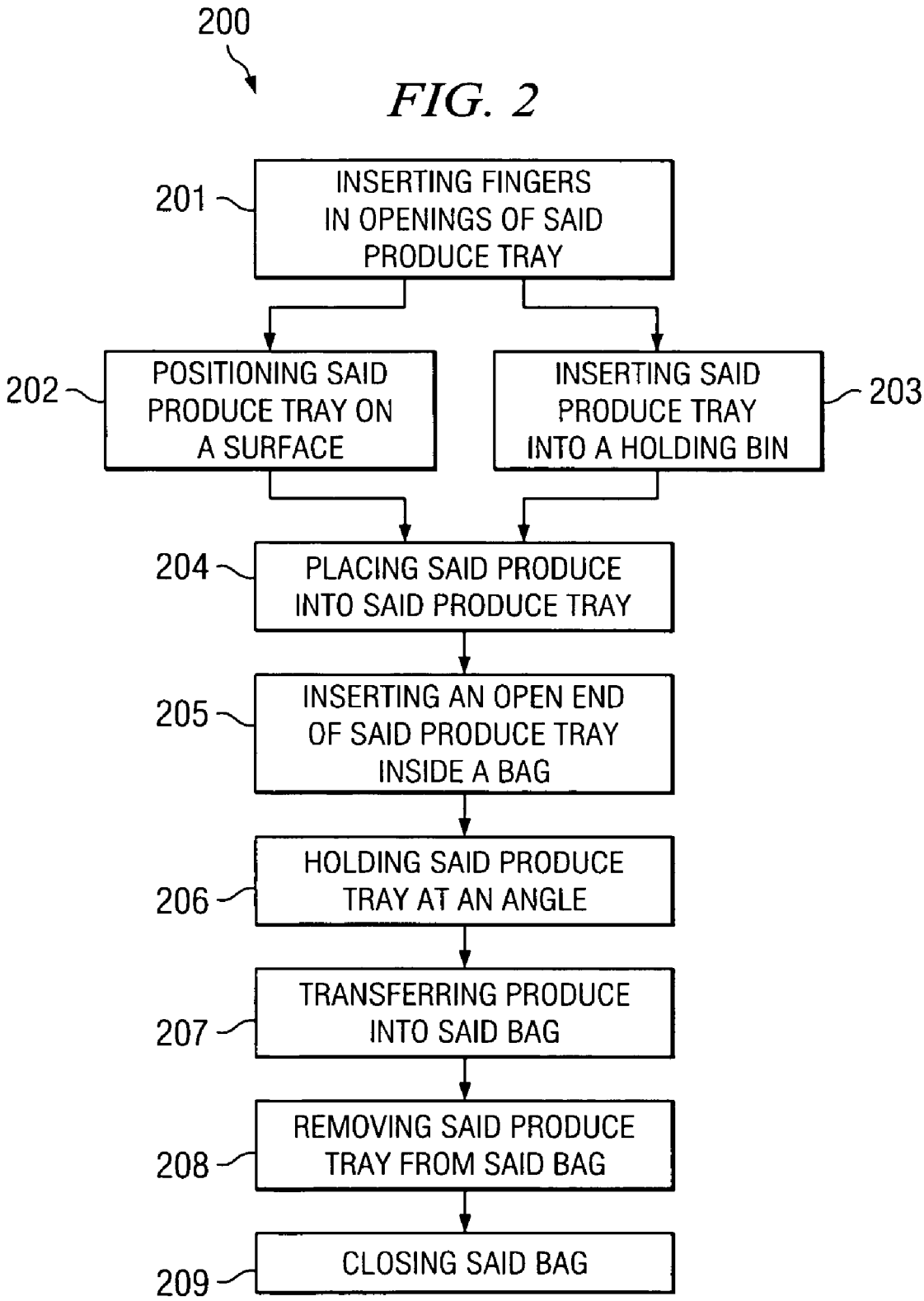
200
FIG. 2
201
INSERTING FINGERS IN OPENINGS OF SAID PRODUCE TRAY
202
POSITIONING SAID PRODUCE TRAY ON A SURFACE
INSERTING SAID PRODUCE TRAY INTO A HOLDING BIN
203
204
PLACING SAID PRODUCE INTO SAID PRODUCE TRAY
205
INSERTING AN OPEN END OF SAID PRODUCE TRAY INSIDE A BAG
206
HOLDING SAID PRODUCE TRAY AT AN ANGLE
207
TRANSFERRING PRODUCE INTO SAID BAG
208
REMOVING SAID PRODUCE TRAY FROM SAID BAG
209
CLOSING SAID BAG

PRODUCE TRAY

CROSS-REFERENCE TO RELATED APPLICATIONS

This application is related to commonly assigned U.S. patent application Ser. No. 10/671,424, entitled "PRODUCE BAG," filed Sep. 25, 2003, as well as commonly assigned U.S. patent application Ser. No. 10/788,712, entitled "SELECTIVE THERMOFORMED BAG," filed Feb. 27, 2004, the disclosures of which are hereby incorporated herein by reference.

TECHNICAL FIELD

This invention is related to containers and more specifically to a tray for holding and transferring produce.

BACKGROUND OF THE INVENTION

Produce is often sold to consumers in prepackaged containers. Each container has an approximate amount of produce. Sometimes produce is sold in a bag, such as a paper sack. The consumer gains access to the bag by opening the bag, placing a desired amount of produce in the bag, and then closing the bag.

Over time, the produce packaging industry has transitioned to a bag that looks or behaves as a stocking, often called an elastic net bag in the industry. When a consumer uses a net bag to store produce, the consumer stretches the bag in order to place a desired amount of produce in the bag. However, this memory bag has several problems associated with it, especially with respect to the loose structure of a memory bag which allows the produce to fall off the vine as the bag is stretched in use.

Accordingly, as the industry has begun to use elastic memory bags to package produce instead of paper bags, concern has developed with respect to transferring produce while maintaining the quality of the packaged produce, particularly produce containing stems or other vined produce.

BRIEF SUMMARY OF THE INVENTION

The present invention is directed to systems and methods which use a tray to transfer produce, such that the produce can be transferred unharmed to a stocking-like type of bag, in order to maintain the quality of the produce on arrival. The tray may be used to transfer produce that is attached to a vine, i.e. tomatoes on the vine. The tray may be constructed from a plastic-like material, such as polyethylene, and the surface of the tray may be smooth to reduce bruising of the produce during transfer.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which:

FIG. 2 depicts an example of a method of using the tray of FIG. 1; and

DETAILED DESCRIPTION OF THE INVENTION

Figure 1:
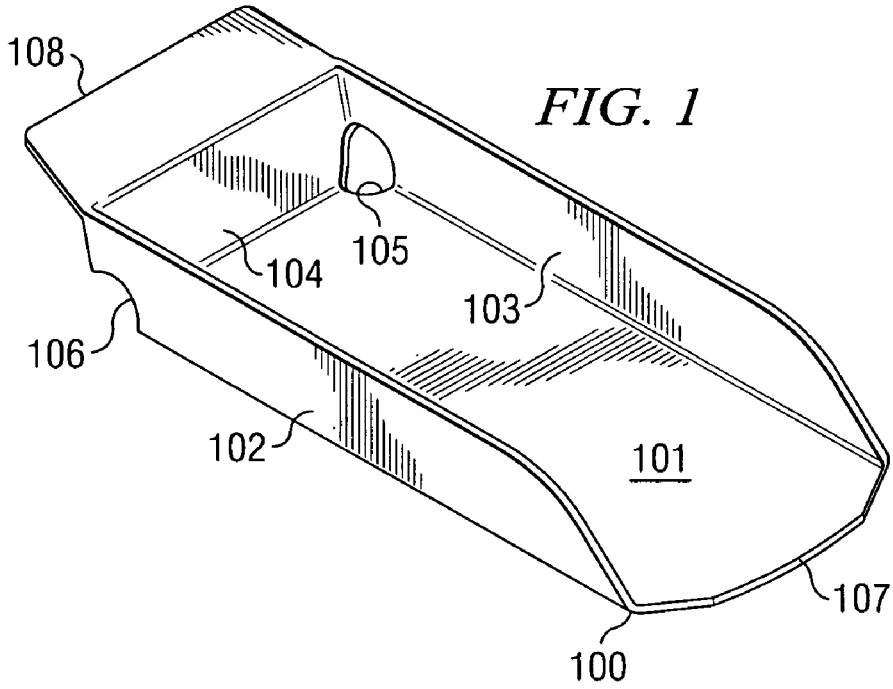
FIG. 1 depicts an example of an embodiment of the invention being used to transfer produce.

FIG. 1 illustrates an example of an embodiment of the present invention. The produce tray 100 depicted in FIG. 1 includes a rectangular bottom wall panel 101 with opposed side walls 102, 103 and an end wall 104. The opposed side walls 102, 103 are joined to and upstanding from the end wall 104 of the tray 100 thereof.

The rectangular bottom wall panel 101 has openings 105, 106 at the corners that intersect with the end wall 104 for receiving the fingers of the user to aid in use of the tray for handling contents of the tray. The openings 105, 106 are positioned in the lower opposing corners of end wall 104 of the produce tray 100. Such openings 105, 106 are large enough for the user to place his/her fingers inside the openings 105, 106 to permit use of the tray 100 with one hand and without the user touching the contents held within the tray 100. The tray may have two openings to allow the tray to be held with either hand. The openings may be used as gripping points for the user, where the user places his/her fingers on or at the openings of the tray. The user may place his/her fingers over the openings in order to manipulate the tray. Such openings are placed to allow for sanitary transfer of produce using the tray and also to allow the user to maintain better control of the tray 100 during produce transfer. Alternatively, the tray may have a single opening positioned to allow use with a specific hand (e.g., left or right). The openings also aid in the cleaning of the tray by providing exit points for water/soap to drain from the tray.

An open end 107 parallel to said end wall 104 protrudes from the tray 100. When produce is to be extracted and placed into a mesh or elastic memory bag for transport and storage, the open end 107 of the produce tray 100 may be used to extract produce from one position, such as a holding bin, for placement on the rectangular bottom panel 101 of the tray 100. This open end 107 preferably has a curved edging so as to reduce the potential for bruising of produce during transfer. The open end 107 may then be inserted into a mesh or elastic memory bag to transfer the produce in the bag for transport and/or storage.

The tray 100 also has a holding device 108 extending from the top of the end wall 104 at a perpendicular angle to the end wall. This holding device 108 provides a leverage point for the user when produce is being transferred using the tray 100. The holding device 108 also adds strength to the end wall 104.

The produce tray depicted in FIG. 1 preferably has specified dimensions in length and width, and the dimensions may change depending on the type of produce being transferred and/or the site of the mesh bag. In one embodiment of the invention, the curved edge of open end 107 of the produce tray 100 may have a radial of 20–40 centimeters. Preferably, the radial is approximately 30 centimeters. This radial may be increased or reduced depending on the size and type of the produce to be transferred. For example, when transfer is being made into a loose type of net bag, a produce tray 100 that is wider may be contemplated.

The inventive produce tray 100 may be constructed from a food-grade polyethylene material. This polyethylene material may be on the order of 2 millimeters in thickness. In an embodiment, the produce tray 100 is formed from polyethylene not containing any color additives. However, aspects of the inventive produce tray may be modified to incorporate colorants or additives for increased resistance to scratching and cracking as well as to provide for increased plasticity.

Other embodiments of the produce tray may use a base material other than polyethylene. The inventive produce tray also may be constructed using polypropylene or polycarbonate. Other embodiments may include forming the produce tray from metals like aluminum or stainless steel if so desired. Metals tend to be heavier and more expensive than plastics, but are more durable.

FIG. 2 depicts an example of a process 200 utilizing the produce tray 100 depicted in FIG. 1. The user places his/her fingers on at least one opening of the tray 201. The user may place his/her fingers inside one or both openings of the tray, or the user may use the openings as gripping points for manipulating the tray by placing his/her fingers on or at the openings of the tray. The tray may be positioned on a surface, such as a table, for loading and transfer of the produce 202. Alternatively, if the produce to be transferred is originally in a holding bin, the scoop-like shape of the open end 107 parallel to the end wall 104 of the tray allows the user to scoop produce from a holding bin 203. Regardless where the produce is originally located, the produce then is placed in the tray 204. The side walls 102, 103 of the tray are positioned such that the produce will remain inside the tray until further transfer occurs. The produce is then transferred to a container, such as an elastic memory bag, by placing the open end 107 of the tray into the container 205, holding the tray at an angle 206, and then transferring the produce into the open end of the container 207. When the produce is loaded into the container, the tray is removed 208, and the open end of the container is closed with a fastener 209.

Figure 3:
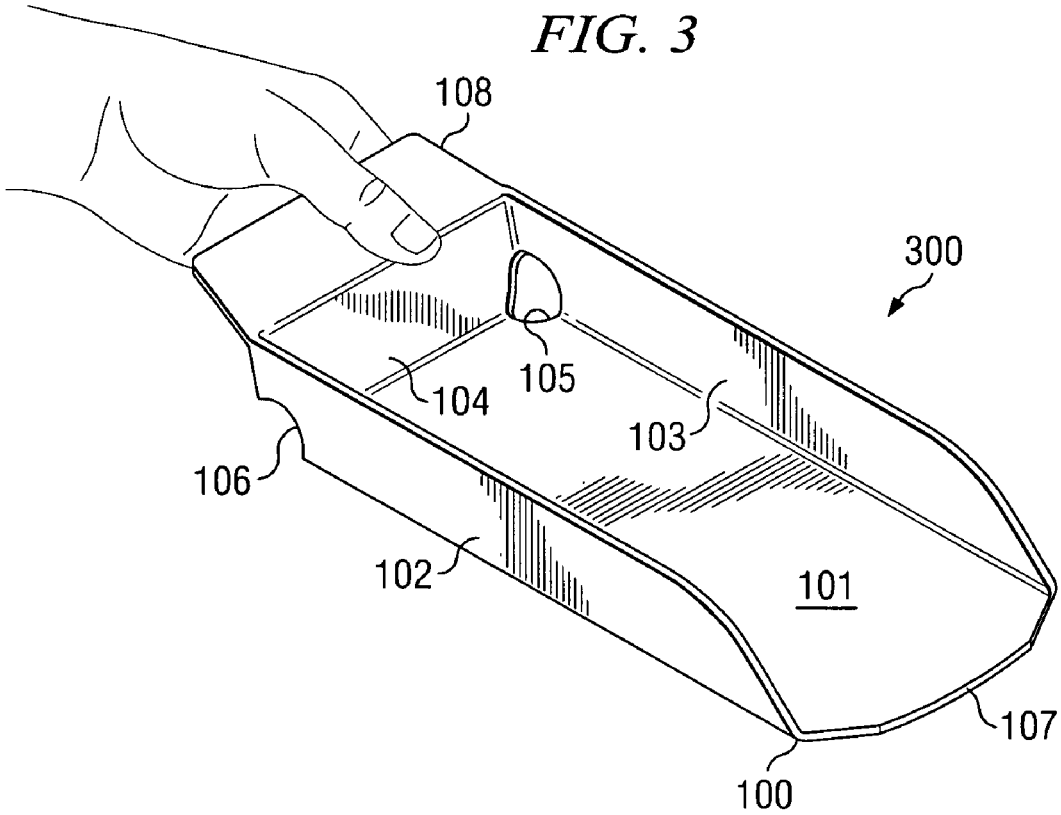
FIG. 3 depicts an example of the invention being used to transfer produce.

FIG. 3 depicts an example 300 of the invention being used to transfer produce. In FIG. 3, the user places his/her fingers on or at one or both of openings 105, 106 of the tray 100 in order to grip or otherwise manipulate and steady the tray during use. The user then places at least one finger on holding device 108 to provide a leverage point for the user when transferring produce using the tray 100. When the user's fingers are positioned on the tray 100, the tray 100 then may be used to collect produce and transfer the produce to a container for further transfer or storage.

This inventive tray preferably is used to transfer a plurality of vined tomatoes, but may hold a different object or objects, such as other produce, other foods, or any other object suitable for transfer using the tray.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A tray for holding and transferring at least one object comprising:

a rectangular bottom wall panel;

a pair of opposed side walls attached to said rectangular bottom wall panel;

an end wall attached to said pair of opposed side walls and to said rectangular bottom wall panel;

at least one opening at a corner of said rectangular bottom panel intersecting with said end wall; and an open end parallel to said end wall;

wherein said rectangular bottom wall panel, said pair of opposed side walls and said end wall comprise the same material.

2. The tray of claim 1 wherein said at least one opening is shaped to permit a user to place a finger at said at least one opening to manipulate said tray.

3. The tray of claim 2 wherein said tray includes two openings.

4. The tray of claim 1, said tray further comprising:

a holding device extending from the top edge of said end wall at a perpendicular angle.

5. The tray of claim 1 wherein said material is polyethylene.

6. The tray of claim 5 wherein said material has a thickness of approximately 2 millimeters.

7. The tray of claim 1 wherein said material is polypropylene.

8. The tray of claim 1, wherein said material is polycarbonate.

9. The tray of claim 1 wherein said material is aluminum or steel.

10. The tray of claim 1 wherein said material includes a colorant.

11. The tray of claim 1 wherein said open end has a curved edge to reduce damage to said at least one object during transfer.

12. A tray for holding produce comprising:

a rectangular bottom wall panel;

a pair of parallel side walls molded lengthwise to said rectangular bottom wall panel;

an end wall molded widthwise to said rectangular bottom wall panel and perpendicular to said pair of parallel side walls;

at least one opening at an intersection point of said rectangular bottom wall panel, one of said pair of parallel side walls, and said end wall; and an open end parallel to said end wall;

wherein said rectangular bottom wall panel, said pair of parallel side walls and said end wall comprise the same material.

13. The tray of claim 12 wherein said produce is a plurality of tomatoes.

14. The tray of claim 12 wherein said produce is attached to a vine.

15. The tray of claim 12 wherein said open end has a curved edge protruding from said tray to reduce damage to said produce during transfer.

16. The tray of claim 12, said tray further comprising:

a holding device extending from the top of said end wall at a perpendicular angle, wherein said holding device provides a leverage point for a user during transfer of produce.

17. A method of using a produce tray, the method comprising:

placing at least one finger on at least one opening of said produce tray;

placing produce in said produce tray;

inserting an open end of said produce tray inside an open end of a container;

holding said produce tray at an angle inside said open end of said container;

transferring said produce into said open end of said container;

removing said produce tray from said open end of said container; and closing said open end of said container.

18. The method of claim 17 wherein said open end of said produce tray has a curved edge to reduce damage to said produce in transfer to said open end of said container.

19. The method of claim 17 wherein the closing of said open end of said container comprises:

attaching a fastener to said open end of said container.

20. The method of claim 17, said method further comprising:

scooping said produce from a holding bin.

21. The method of claim 17, said method further comprising:

positioning said produce tray on a surface.

22. The method of claim 17 wherein said container is an elastic memory bag.

* * * * *